US005146652A

United States Patent [19]

Leifeld

[11] Patent Number: 5,146,652

[45] Date of Patent: Sep. 15, 1992

[54] APPARATUS FOR OPENING AND CLEANING FIBER MATERIAL

[75] Inventor: Ferdinand Leifeld, Kempen, Fed. Rep. of Germany

[73] Assignee: Trützschler GmbH & Co. KG, Möchen-Gladbach, Fed. Rep. of Germany

[21] Appl. No.: 644,538

[22] Filed: Jan. 23, 1991

[30] Foreign Application Priority Data

Jan. 23, 1990 [DE] Fed. Rep. of Germany ..... 4001816

[51] Int. Cl.[5] ..... D01B 3/00

[52] U.S. Cl. ..... 19/204; 19/203; 19/200

[58] Field of Search ..... 19/98, 99, 100, 101, 19/105, 106 R, 107, 108, 109, 200, 203, 204, 202, 205

[56] References Cited

U.S. PATENT DOCUMENTS

| | | | |
|---|---|---|---|
| 2,014,673 | 9/1935 | Setzer | 19/99 |
| 2,936,495 | 5/1960 | Taine et al. | 19/106 R |
| 3,081,499 | 3/1963 | Goldman | 19/99 |
| 4,219,908 | 9/1980 | Winch et al. | 19/107 |
| 4,539,728 | 9/1985 | Portell | 19/105 |
| 4,852,217 | 8/1989 | Bernhardt et al. | 19/106 R |

FOREIGN PATENT DOCUMENTS

| | | | |
|---|---|---|---|
| 849548 | 9/1960 | United Kingdom . | |
| 2214535 | 9/1980 | United Kingdom . | |
| 1586940 | 5/1981 | United Kingdom . | |
| 2134553 | 8/1984 | United Kingdom . | |
| 2222607 | 3/1990 | United Kingdom | 19/105 |

*Primary Examiner*—Werner H. Schroeder
*Assistant Examiner*—Michael A. Neas
*Attorney, Agent, or Firm*—Spencer, Frank & Schneider

[57] ABSTRACT

An apparatus for opening and cleaning fiber material includes consecutively arranged first, second and third clothed rolls each having a clothing thereon. The second clothed roll cooperates with the first clothed roll as a doffer and opening roll and the third clothed roll cooperates with the second clothed roll as a doffer and opening roll. The centrifugal forces generated at peripheries of the clothed rolls increase from roll to roll from the first clothed roll. There is further provided a fiber feeder for advancing the fiber material towards the first clothed roll. Covers closely surround the respective first, second and third clothed rolls which have at least approximately identical diameters. Waste discharge openings are provided in the cover of each clothed roll, and a mote knife bounds each waste discharge opening.

10 Claims, 3 Drawing Sheets

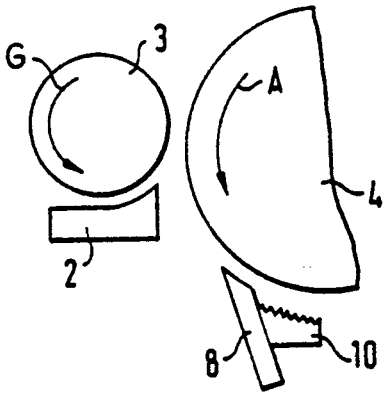
FIG. 3
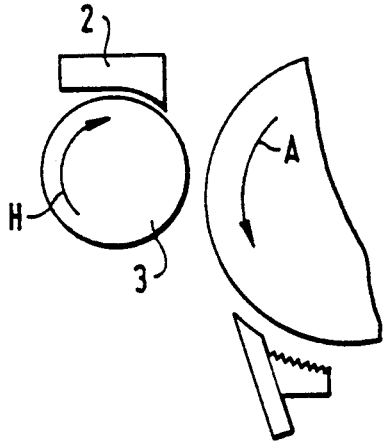
FIG. 4
FIG. 5
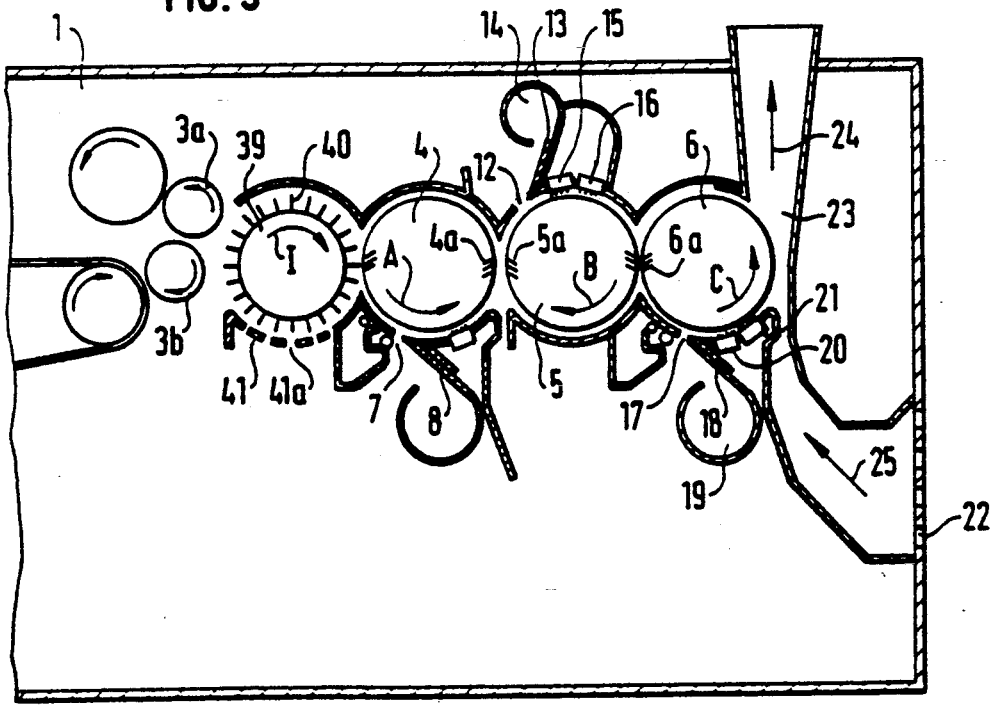

APPARATUS FOR OPENING AND CLEANING FIBER MATERIAL

CROSS REFERENCE TO RELATED APPLICATION

This application claims the priority of Federal Republic of Germany Application No. P 40 01 816.4 filed Jan. 23, 1990, which is incorporated herein by reference.

BACKGROUND OF THE INVENTION

This invention relates to an apparatus for opening and cleaning fiber material, particularly cotton. The apparatus is of the type which has at least three clothed rolls arranged downstream of a fiber feeder. At least two of the clothed rolls are each associated with at least one mote knife and a waste discharge opening bounded by the mote knife. The centrifugal force at the circumference of any one of the clothed rolls is greater than the clothed roll or clothed rolls upstream thereof. The clothed rolls are arranged in a series and each clothed roll cooperates with the immediately preceding clothed roll as a doffer and opening roll.

In a known apparatus of the above-outlined type there are provided three serially arranged clothed rolls in which the diameter of the first clothed roll and the adjoining clothed roll are different. The second clothed roll is surrounded by a housing which is void of waste discharge openings or mote knives. It is a disadvantage of this arrangement that the unlike roll diameters result in certain additional manufacturing costs.

SUMMARY OF THE INVENTION

It is an object of the invention to provide an improved apparatus of the above-outlined type from which the discussed disadvantage is eliminated and which, in particular, allows a simpler manufacture and an improved cleaning effect.

This object and others to become apparent as the specification progresses, are accomplished by the invention, according to which, briefly stated, the diameter of each clothed roll is at least approximately the same and each clothed roll is associated with at least one mote knife and one waste discharge opening.

By providing that each clothed roll has substantially the same diameter, the manufacture thereof is simplified and by associating each clothed roll with a mote knife and a waste discharge opening, the cleaning effect of the apparatus is improved.

BRIEF DESCRIPTION OF THE DRAWING

FIGS. 3 and 4 are schematic side elevational views of two variants of fiber feeding devices.

FIGS. 5, 6 and 7 are schematic side elevational views of three further preferred embodiments of the invention.

DESCRIPTION OF THE PREFERRED EMBODIMENTS

Figure 1:
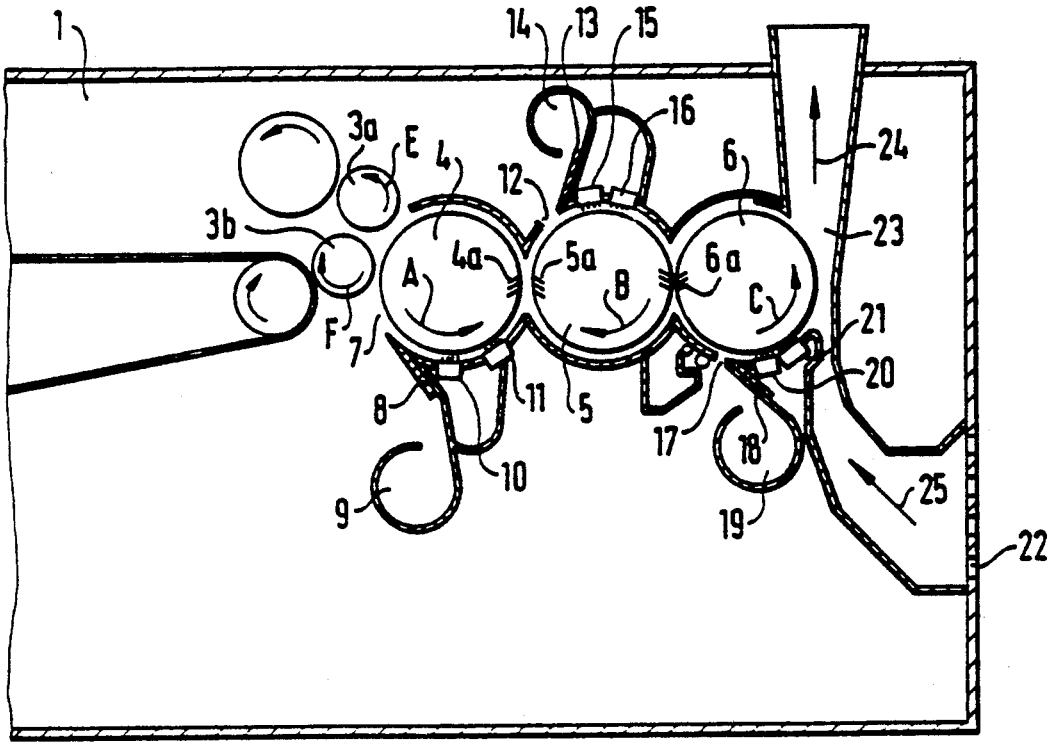
FIGS. 1 and 2 are schematic side elevational views of two preferred embodiments of the invention.

FIG. 1 illustrates a cleaning apparatus accommodated in a closed housing 1. The fiber material to be cleaned (particularly cotton) is supplied in fiber tuft form by, for example, a non-illustrated feed chute. The fiber lap is, by means of two feed rolls 3*a* and 3*b* which rotate in opposite directions as indicated by arrows E, F, clamped and advanced by their nip to a first clothed roll 4 which is supported in the housing 1 and which rotates counterclockwise as indicated by the arrow A. Downstream of the clothed roll 4 there is arranged a second clothed roll 5 (rotating in direction B) and a third clothed roll 6 (rotating in direction C). The clothed rolls 4, 5 and 6 have a sawtooth clothing and have essentially the same diameter between approximately 135 mm to 215 mm, for example, 175 mm. The clothed roll 4 has a circumferential speed between approximately 15–21 m/sec, for example, 18 m/sec, the clothed roll 5 has a circumferential speed between approximately 19–25 m/sec, for example, 22 m/sec and the clothed roll 6 has a circumferential speed between approximately 23–30 m/sec, for example, 26.5 m/sec.

The clothed rolls 4, 5 and 6 are closely surrounded by covers (housing portions). With the clothed roll 4 there is associated a waste discharge opening 7 for the exit of fiber impurities whose size is adapted or is adaptable to the actual separating stage. The waste discharge opening 7 is bounded by a mote knife 8 having a knife edge 8' oriented in a direction opposite to the direction of rotation of the clothed roll 4. With the waste discharge opening 7 there is associated a suction chamber 9 through which the waste is removed by an air stream. Further, two fixed carding elements 10 and 11 cooperate with the clothing of the roll 4. In a similar arrangement, the clothed roll 5 cooperated with a waste discharge opening 12 bounded by a mote knife 13, a suction chamber 14, as well as fixed carding elements 15, 16 and also, the clothed roll 6 cooperates with a waste discharge opening 17 bounded by a mote knife 18, a suction chamber 19, as well as fixed carding elements 20, 21.

The third clothed roll 6 rotates with a higher rpm than the clothed rolls 4 and 5. The clothing points 6*a* of the roll 6 are oriented in a doffing position relative to the clothing points 5*a* of the second clothed roll 5. Accordingly, the clothed roll 6 may be designated as a doffer and opening roll. The clothing points 5*a* of the roll 5 are oriented in a doffing position to the clothing points 4*a* of the first roll 4. The number of clothing points 5*a* is greater than the number of clothing points 4*a*, whereas the number of clothing points 6*a* is greater than the number of clothing points 5*a*. Since the clothing rolls 4, 5, 6 have essentially the same diameter and since the rpm increases from roll to roll as viewed in the direction of fiber advance, the centrifugal force imparted on the fiber material thus also increases from roll to roll in the direction of fiber advance. A fiber conveying duct 23 extends tangentially to the clothed roll 6 toward a non-illustrated screen drum. The fiber material is removed from the clothed roll 6 and transported pneumatically by an air stream 25 in the duct 23. The screen drum is, for generating a vacuum in its inside, connected to a suction device (not shown). The vacuum extends in the fiber conveying duct 14 up to the last clothed roll 6.

In the description which follows, the operation of the above-described cleaning apparatus will be set forth.

The fiber lap consisting of fiber tufts is advanced through the nip of the feed rolls 3*a* and 3*b* under a clamping effect to the first clothed roll 4 which combs the fiber material and entrains bunches of fiber on its clothing. As the circumferential portions of the clothed roll 4 pass in front of the waste discharge opening 7 bounded by the mote knife 8, short fibers and coarse impurities are thrown from the fiber material by centrifugal forces through the waste discharge opening 7, dependent upon the circumferential speed and the curvature of the roll 4 as well as the magnitude of the waste discharge opening 7, adapted to the first waste separating phase. The separated waste material is, after passing through the waste discharge opening 7, admitted to a waste chamber in the housing 1. The fiber material pre-cleaned in this manner is taken off by the clothing points 5*a* of the second clothed roll 5 from the first clothed roll 4, while a additional opening of the fiber material takes place. As the circumferential surface of the clothed roll 5 passes in front of a waste discharge opening 12, bounded by a mote knife 13, further impurities are removed from the fiber material by centrifugal forces.

Thereafter, the fiber material is taken off the second clothed roll 5 by the clothing points 6*a* of the third clothed roll 6, with simultaneous further opening and the fiber material is entrained by the clothed roll 6 to pass in front of a waste discharge opening 17 bounded by a mote knife 18. Since the centrifugal forces generated on the surface of the third clothed roll 6 are greater than on the first clothed roll 4, it is the finer dirt and dust particles which are thrown out by centrifugal forces from the surface of the clothed roll 6 through the waste discharge opening 17. By opening the fiber material into individual fibers or at least into very fine fiber tufts by the clothed roll 6, a separation of the fine impurities from the fiber material is enhanced. The impurities and fiber fragments separated through the waste discharge openings 7, 12 and 17 are removed through vacuum ducts in a continuous or intermittent manner. After passing the waste discharge opening 17, the fiber material is separated from the third clothed roll 6 by means of the air flow 25 entering the intake slot 22 as well as by means of centrifugal forces and is admitted through the fiber conveying conduit 23 to a screen drum or a dust removal machine which may be, for example, a DUSTEX DX model, manufactured by Trützschler GmbH & Co. KG, Mönchengladbach, Germany. The fine and finest impurities such as dust and fiber fragments enter through the perforated jacket of the rotating screen drum and are removed by a vacuum stream while the larger fibers adhere to the outer surface of the screen drum and form thereon a fiber lap which is removed from the screen drum and advanced for further processing.

Figure 2:
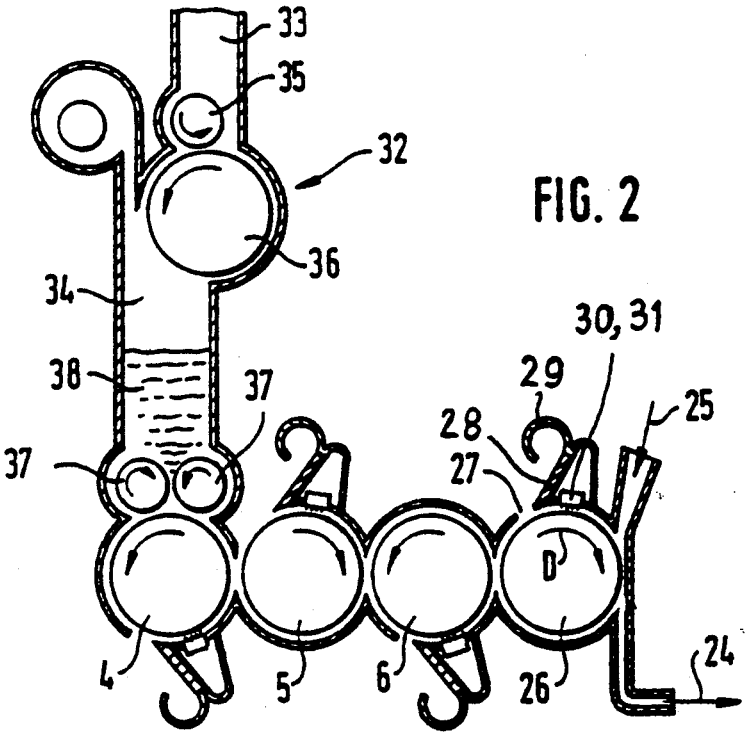

Turning to the embodiment illustrated in FIG. 2, downstream of the third clothed roll 6 there is arranged a fourth clothed roll 26 which rotates in the direction D and with which cooperate a waste discharge opening 27, a mote knife 28, a suction chamber 29 and two fixed carding elements 30, 31. Above the clothed roll 4 there is arranged a tuft feeder 32 which may be, for example, an EXACTAFEED FBK model, manufactured by Trützschler GmbH & Co. KG. The tuft feeder 32 has an upper or reserve chute 33, a lower or feed chute 34 adjoining the reserve chute 33. Between the chutes 33 and 34 there is arranged a slowly rotating feed roll 35 and a rapidly rotating opening roll 36. At the lower end of the feed chute 34 there are arranged two delivery rolls 37 which advance the fiber material 38 directly to the clothed roll 4.

Turning to FIG. 3, the clothed roll 4 is immediately preceded by a feeding device formed of a feed roll 3 slowly rotating in the direction G and a feed table 2. Thus, the feed roll 3 and the clothed roll 4 both rotate counterclockwise.

FIG. 4 shows a variant of the FIG. 3 feed arrangement. In FIG. 4 the feed roll 3 rotates clockwise in the direction H. Thus, in the zone where the fiber material is transferred from the feed roll 3 to the clothed roll 4, 5 the surface portions of the two rolls—as opposed to the FIG. 2 arrangement—move in the same direction, effecting a "codirectional" fiber feed.

Turning to FIG. 5, between the feed rolls 3*a* and 3*b* and the first clothed roll 4 there is provided a roll 39 which has pins 40 on its surface and which rotates as indicated by the arrow I. Underneath the roll 39 a grate 41 is disposed which has openings 41*a* through which the impurities separated from the fiber material may pass.

Figure 6:
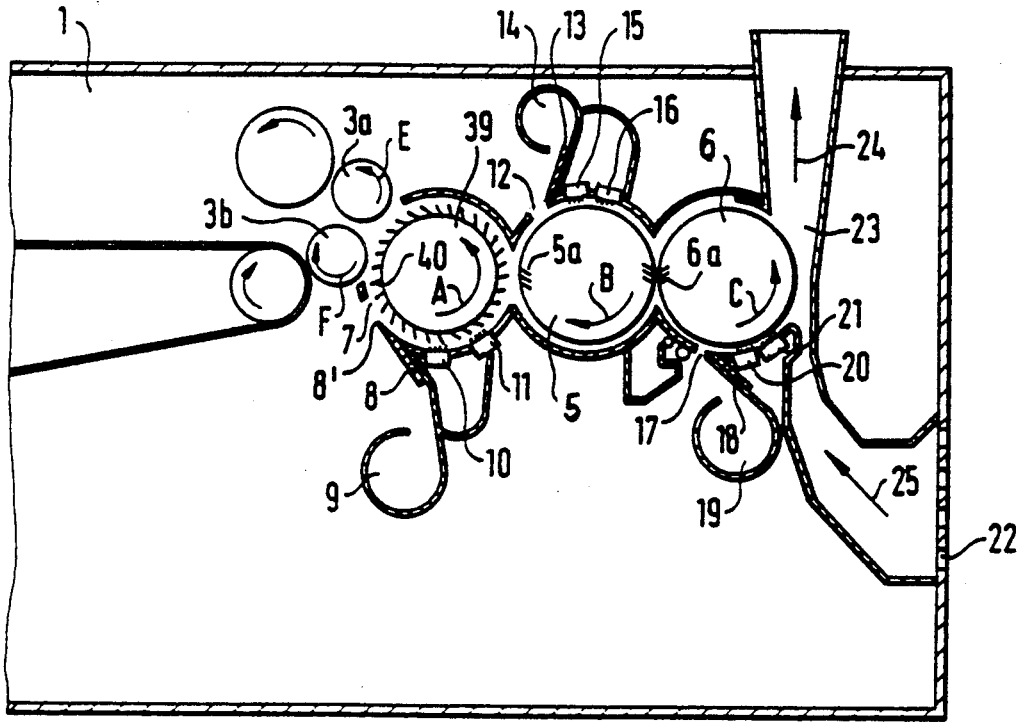

The embodiment illustrated in FIG. 6 differs from the FIG. 1 structure essentially in that the first clothed roll 39 is a needle-surfaced roll and the two consecutive clothed rolls 5 and 6 have sawtooth clothings.

Figure 7:
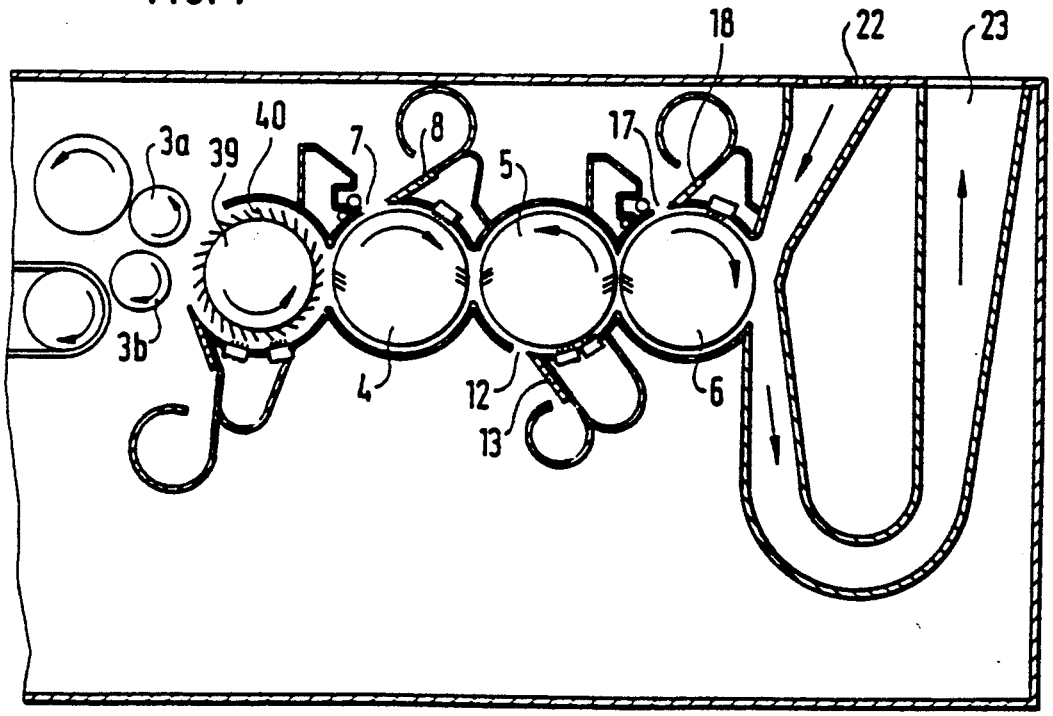

In the embodiment according to FIG. 7, the clothed roll 39 provided with needles is adjoined in series by three rolls 4, 5 and 6 having a sawtooth clothing.

By providing a pin- or needle-surfaced roll 39 as the first clothed roll as shown in the embodiments of FIGS. 5, 6 and 7, the apparatus integrally incorporates a precleaner for the fiber material.

It will be understood that the above description of the present invention is susceptible to various modifications, changes and adaptations, and the same are intended to be comprehended within the meaning and range of equivalents of the appended claims.

What is claimed is:

1. In an apparatus for opening and cleaning fiber material, including consecutively arranged first, second and third clothed rolls each having a clothing thereon; said second clothed roll cooperating with said first clothed roll as a doffer and opening roll and said third clothed roll cooperating with said second clothed roll as a doffer and opening roll; further wherein centrifugal forces generated at peripheries of said clothed rolls increase from roll to roll from the first clothed roll; fiber feeding means for advancing the fiber material towards said first clothed roll; and covers each closely surrounding the respective said first, second and third clothed rolls; the improvement wherein said first, second and third clothed rolls have at least approximately identical diameters; the improvement further comprising a waste discharge opening provided in the cover of each clothed roll; a mote knife bounding each waste discharge opening; and an additional clothed roll situated between said fiber feeding means and said first clothed roll; said additional clothed roll having a clothing formed of pins or needles; said additional clothed roll being arranged for receiving the fiber material from said fiber feeding means and for transferring the fiber material to said first clothed roll.

2. An apparatus as defined in claim 1, further comprising a fixed clothed carding element cooperating with each clothed roll.

3. An apparatus as defined in claim 1, wherein said fiber feeding means comprises two slowly rotating, cooperating feed rolls.

4. An apparatus as defined in claim 1, wherein said fiber feeding means comprises a feed table and a slowly rotating feed roll cooperating with the feed table.

5. An apparatus as defined in claim 1, wherein said fiber feeding means comprises a fiber tuft feeder including a feed chute.

6. An apparatus as defined in claim 1, further comprising an additional cover closely surrounding said additional roll; an additional waste discharge opening provided in said additional cover and an additional mote knife bounding said additional waste discharge opening.

7. An apparatus as defined in claim 1, wherein the clothing of said first, second and third clothed rolls is formed of sawteeth.

8. An apparatus as defined in claim 1, further comprising a fiber conveying duct oriented generally tangentially to the third clothed roll for guiding an air stream therein to remove the fiber material from said third clothed roll.

9. In an apparatus for opening and cleaning fiber material, including consecutively arranged first, second and third clothed rolls each having a clothing thereon; said second clothed roll cooperating with said first clothed roll as a doffer and opening roll and said third clothed roll cooperating with said second clothed roll as a doffer and opening roll; further wherein centrifugal forces generated at peripheries of said clothed rolls increase from roll to roll from the first clothed roll; fiber feeding means for advancing the fiber material towards said first clothed roll; and covers each closely surrounding the respective said first, second and third clothed rolls; the improvement wherein said first, second and third clothed rolls have at least approximately identical diameters; and further wherein the clothing of said first clothed roller is formed of pins or needles and the clothing of said second and third clothed rolls is formed of sawteeth; the improvement further comprising a waste discharge opening provided in the cover of each clothed roll; and a mote knife bounding each waste discharge opening.

10. An apparatus as defined in claim 9, wherein each clothing has clothing points and further wherein the number of clothing points on the second clothed roll is greater than the number of clothing points on the first clothed roll and the number of clothing points on the third clothed roll is greater than the number of clothing points on the second clothed roll.

* * * * *